US010137456B1

(12) United States Patent
Lansell et al.

(10) Patent No.: US 10,137,456 B1
(45) Date of Patent: Nov. 27, 2018

(54) REACTOR CONFIGURED TO FACILITATE CHEMICAL REACTIONS AND/OR COMMINUTION OF SOLID FEED MATERIALS

(71) Applicant: LLT International (Ireland) Ltd., Dublin (IE)

(72) Inventors: Peter Lansell, Kew (AU); William Keating, Fairfield (AU); David Lowe, Alphington (AU)

(73) Assignee: LLT International (Ireland) Ltd., Dublin (IE)

( * ) Notice: Subject to any disclaimer, the term of this patent is extended or adjusted under 35 U.S.C. 154(b) by 810 days.

(21) Appl. No.: 14/719,303

(22) Filed: May 21, 2015

Related U.S. Application Data

(63) Continuation of application No. 14/298,868, filed on Jun. 6, 2014, now Pat. No. 9,050,604.

(51) Int. Cl.
*B02C 19/00* (2006.01)
*B02C 19/06* (2006.01)

(52) U.S. Cl.
CPC ..... *B02C 19/063* (2013.01); *B02C 19/06* (2013.01); *B02C 19/061* (2013.01)

(58) Field of Classification Search
CPC ..... B02C 19/06; B02C 19/061; B02C 19/063; B02C 19/066; B02C 19/068
USPC ..... 241/39–40
See application file for complete search history.

(56) References Cited

U.S. PATENT DOCUMENTS 2,257,907 A 10/1941 Griswold ..... 252/291
2,532,554 A 12/1950 Joeck
2,752,097 A 6/1956 Lecher
2,997,245 A 8/1961 Nilsson et al.
3,178,121 A 4/1965 Wallace, Jr. ..... 241/5
3,254,848 A 6/1966 Stephanoff ..... 241/39
(Continued)

FOREIGN PATENT DOCUMENTS

DE 102013019949 5/2015
EA 000004 9/1997
(Continued)

OTHER PUBLICATIONS

Final Office Action dated Jan. 27, 2017 in corresponding U.S. Appl. No. 14/690,149 (14 pages).
(Continued)

*Primary Examiner* — Faye Francis
(74) *Attorney, Agent, or Firm* — Pillsbury Winthrop Shaw Pittman LLP

(57) ABSTRACT

A reactor may be configured to facilitate chemical reactions and/or comminution of solid feed materials. The reactor may be configured to make use of shockwaves created in a supersonic gaseous vortex. The reactor may include a rigid chamber having a substantially circular cross-section. A gas inlet may be configured to introduce a high-velocity stream of gas into the chamber. The gas inlet may be disposed and arranged so as to effectuate a vortex of the stream of gas circulating within the chamber. The vortex may rotate at a supersonic speed about a longitudinal axis of the chamber. A material inlet may be configured to introduce a material to be processed into the chamber. The material may be processed within the chamber by nonabrasive mechanisms facilitated by shockwaves within the chamber. An outlet may be configured to emit the gas and processed material from the chamber.

29 Claims, 5 Drawing Sheets

(56) References Cited

U.S. PATENT DOCUMENTS

| | | | | |
|---|---|---|---|---|
| 3,257,080 | A | 6/1966 | Snyder | 241/5 |
| 3,301,292 | A | 1/1967 | O'Connor | 146/221.5 |
| 3,462,086 | A | 8/1969 | Bertrand et al. | 241/5 |
| 3,565,348 | A | 2/1971 | Dickerson et al. | 241/5 |
| 3,602,439 | A | 8/1971 | Nakayama | 241/39 |
| 3,620,946 | A | 11/1971 | Michel | |
| 3,908,904 | A | 9/1975 | Kerner et al. | |
| 4,198,004 | A | 4/1980 | Albus et al. | 241/39 |
| 4,248,387 | A | 2/1981 | Andrews | 241/5 |
| 4,354,641 | A | 10/1982 | Smith | |
| 4,515,093 | A | 5/1985 | Beardmore et al. | 110/347 |
| 4,671,192 | A | 6/1987 | Hoffert et al. | 110/347 |
| 4,919,853 | A | 4/1990 | Alvarez et al. | |
| 4,921,173 | A | 5/1990 | Bartley | |
| 5,219,530 | A | 6/1993 | Hertzberg et al. | |
| 5,246,575 | A | 9/1993 | Alexander | |
| 5,277,369 | A | 1/1994 | Moriya et al. | |
| 5,306,330 | A | 4/1994 | Nasikas | |
| 5,855,326 | A | 1/1999 | Beliaysky | 241/5 |
| 6,089,026 | A | 7/2000 | Hu | |
| 6,145,765 | A | 11/2000 | Capelle, Jr. et al. | 241/5 |
| 6,152,158 | A | 11/2000 | Hu | |
| 6,158,676 | A | 12/2000 | Hughes | |
| 6,167,323 | A | 12/2000 | Komino et al. | |
| 6,824,086 | B1 | 11/2004 | Mazurkiewicz et al. | |
| 7,137,580 | B2 | 11/2006 | Graham et al. | 241/1 |
| 7,398,934 | B1 | 7/2008 | Capelle, Jr. | 241/5 |
| 7,621,473 | B2 | 11/2009 | Capelle, Jr. | 241/5 |
| 7,789,331 | B2 | 9/2010 | Zehavi et al. | 241/5 |
| 7,850,105 | B2 | 12/2010 | Ito et al. | 241/39 |
| 8,172,163 | B2 | 5/2012 | Soliman Abdalla et al. | 241/1 |
| 8,398,007 | B2 | 3/2013 | Ito et al. | 241/39 |
| 8,480,859 | B2 | 7/2013 | Kostrov et al. | 196/14.52 |
| 8,726,532 | B2 | 5/2014 | Hogan | |
| 9,050,604 | B1 | 6/2015 | Lansell et al. | |
| 2004/0063874 | A1 | 4/2004 | Muhle et al. | |
| 2004/0200910 | A1 | 10/2004 | Graham et al. | 241/5 |
| 2006/0144760 | A1 | 7/2006 | Duyvesteyn | |
| 2007/0267527 | A1 | 11/2007 | Graham et al. | 241/39 |
| 2008/0226535 | A1 | 9/2008 | Park et al. | 423/447.3 |
| 2009/0241816 | A1 | 10/2009 | Taylor | |
| 2010/0025506 | A1 | 2/2010 | Capelle, Jr. | 241/5 |
| 2010/0101978 | A1 | 4/2010 | Gordon et al. | |
| 2011/0206593 | A1 | 8/2011 | Fahs | 423/351 |
| 2011/0283705 | A1 | 11/2011 | Oliver | |
| 2012/0131901 | A1 | 5/2012 | Westervelt et al. | |
| 2012/0230877 | A1 | 9/2012 | Pinchot | 422/128 |
| 2013/0221141 | A1 | 8/2013 | Zhang et al. | 241/39 |
| 2013/0224488 | A1 | 8/2013 | Dos Santos Antunes et al. | |
| 2013/0315792 | A1 | 11/2013 | O'Dowd | |
| 2013/0336845 | A1 | 12/2013 | Chu | 422/128 |
| 2014/0058095 | A1 | 2/2014 | Rende et al. | |
| 2014/0058170 | A1 | 2/2014 | Bedard | |
| 2014/0110307 | A1 | 4/2014 | Salazar-Guillen | |
| 2014/0275687 | A1 | 9/2014 | Beene et al. | |
| 2015/0165414 | A1 | 6/2015 | Gattupalli et al. | |
| 2015/0352558 | A1 | 12/2015 | Lansell et al. | |
| 2015/0361010 | A1 | 12/2015 | Leonard | |
| 2016/0243488 | A1 | 8/2016 | Wells et al. | |
| 2016/0296904 | A1 | 10/2016 | Knowlen | |

FOREIGN PATENT DOCUMENTS

| | | |
|---|---|---|
| FR | 1048667 | 12/1953 |
| GB | 1037770 | 8/1966 |
| RU | 2 029 621 | 2/1995 |
| RU | 2 088 336 | 8/1997 |
| WO | WO 94/08719 | 4/1994 |
| WO | WO 97/33695 | 9/1997 |
| WO | 2008/083138 | 7/2008 |

OTHER PUBLICATIONS

Final Office Action dated Dec. 29, 2016 in corresponding U.S. Appl. No. 14/823,890 (14 pages).

Derwent abstract of DE 102013019949 A1.

English machine translation for FR 1048667 A (Dec. 1953).

International Search Report and Written Opinion dated Sep. 26, 2016 in corresponding International Patent Application No. PCT/US2016/046641.

Final Office Action dated Dec. 6, 2016 in corresponding U.S. Appl. No. 14/298,877 (10 pages).

M. Reader-Harris, Orifice Plates and Venturi Tubes, Chapter 3: Venturi Tube Design, 2015, pp. 77-96.

Demare, D., et al., "Acoustic enhancement of combustion in lifted non-remixed jet flames", The Combusion Institute, 139 (2004), 312-328, Elsevier, Inc.

Simpson, E., et al., Acoustic Performance of a Cylindrical Disk-Type Resonator, Journal of Sound and Vibration, (1978) 60(1), 151-156, Academic Press Inc. (London) Limited.

Narayanan, S., et al. "Acoustic characteristics of chamfered Hartmann whistles", Journal of Sound and Vibration, 330 (2011) 2470-2496, Elsevier, Ltd.

Narayanan, S. et al., Aero-acoustic features of internal and external chamfered Hartmann whistles: A comparative study, Journal of Sound and Vibration, 333 (2014) 774-787, Elsevier, Ltd.

International Search Report & Written Opinion of the International Searching Authority issued in PCT/US2016/028181 dated May 20, 2016.

International Preliminary Report on Patentability issued in PCT/US/2016/028181 dated Oct. 17, 2017.

International Search Report and Written Opinion of the International Searching Authority issued in PCT/US2016/028167 dated Jul. 25, 2016.

International Preliminary Report on Patentability issued in PCT/US2016/028167 dated Oct. 17, 2017.

International Preliminary Report on Patentability PCT/US2016/046641 dated Feb. 13, 2018.

Non-final Office Action U.S. Appl. No. 14/823,890 dated Jan. 29, 2018.

Non-final Office Action U.S. Appl. No. 14/690,149 dated Jan. 25, 2018.

International Preliminary Report on Patentability and the Written Opinion of the International Searching Authority as issued in International Patent Application No. PCT/US2015/034554, dated Sep. 3, 2015.

International Preliminary Report on Patentability and the Written Opinion of the International Searching Authority as issued in International Patent Application No. PCT/US2015/034548, dated Sep. 8, 2015.

Hartmann, J. et al, "Synchronisation of Air-Jet Generators with an Appendix on the Stem Generator", Det Kgl. Danske Videnskabernes Selskab. Matematisk-fysiske Meddelelser, Bd. 26, No. 10, 1951(39 pages).

Details of the First Office Action Chinese Patent Application No. 201680035572.0 dated Jul. 24, 2018 with English translation.

Final Office Action U.S. Appl. No. 14/690,149 dated Sep. 4, 2018.

Final Office Action U.S. Appl. No. 14/823,890 dated Sep. 4, 2018.

REACTOR CONFIGURED TO FACILITATE CHEMICAL REACTIONS AND/OR COMMINUTION OF SOLID FEED MATERIALS

CROSS-REFERENCE TO RELATED APPLICATIONS

This application is a continuation of U.S. patent application Ser. No. 14/298,868, filed Jun. 6, 2014, entitled "Reactor Configured to Facilitate Chemical Reactions and/or Comminution of Solid Feed Materials", the entirety of which is incorporated herein by reference.

FIELD OF THE DISCLOSURE

This disclosure relates to a reactor configured to facilitate chemical reactions and/or comminution of solid feed materials. The reactor may make use of shockwaves created in a supersonic gaseous vortex.

BACKGROUND

Conventional approaches to comminution may include use of jet mills. Jet mills may be used for grinding a range of materials, particularly in cases where the feed material is hard or already relatively fine and where high purity products, without contamination, are required. Pulverization may take place in a central toroidal chamber of the jet mill as the process material is driven around the perimeter of the chamber by multiple jets of air or steam. No grinding media may be involved. Size reduction via attrition may be the result of high-velocity collisions and resulting compressive forces between particles of the process material itself and/or between particles of the processes material and interior walls of the chamber.

SUMMARY

Exemplary implementations may provide a reactor in which materials are comminuted via tensive forces resulting from shockwaves induced within a chamber of the reactor. Utilizing tensive forces rather than compressive forces to comminute the feed material may result in substantial energy savings. For example, it may take 1/10 the energy to pull stone apart with tensile forces compared to crushing stone using compressive forces. Some implementations may include a Hartmann-type pulsator in a gas inlet stream to convert incoming gas into an ultrasonic jet, which results in the production of shockwaves in the chamber. A venturi positioned at an outlet of the chamber may pressurize the chamber and facilitate rapid cooling of processed material exiting the chamber, which may reduce or minimize back reactions, according to some implementations.

One aspect of the disclosure relates to a reactor configured to facilitate chemical reactions and/or comminution of solid feed materials using shockwaves created in a supersonic gaseous vortex. The reactor may comprise a rigid chamber, a gas inlet, a material inlet, and an outlet. The chamber may have a substantially circular cross-section centered on a longitudinal axis that is normal to the cross-section. The gas inlet may be configured to introduce a high-velocity stream of gas into the chamber. The gas inlet may be disposed and arranged so as to effectuate a vortex of the stream of gas circulating within the chamber. The vortex may rotate at a supersonic speed about the longitudinal axis of the chamber. The material inlet may be configured to introduce a material to be processed into the chamber. The material inlet may be positioned proximal to the gas inlet. The material may be processed within the chamber by nonabrasive mechanisms facilitated by shockwaves within the chamber. The outlet may be configured to emit the gas and processed material from the chamber. The outlet may be positioned at an opposite end of the chamber as the gas inlet and the material inlet.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
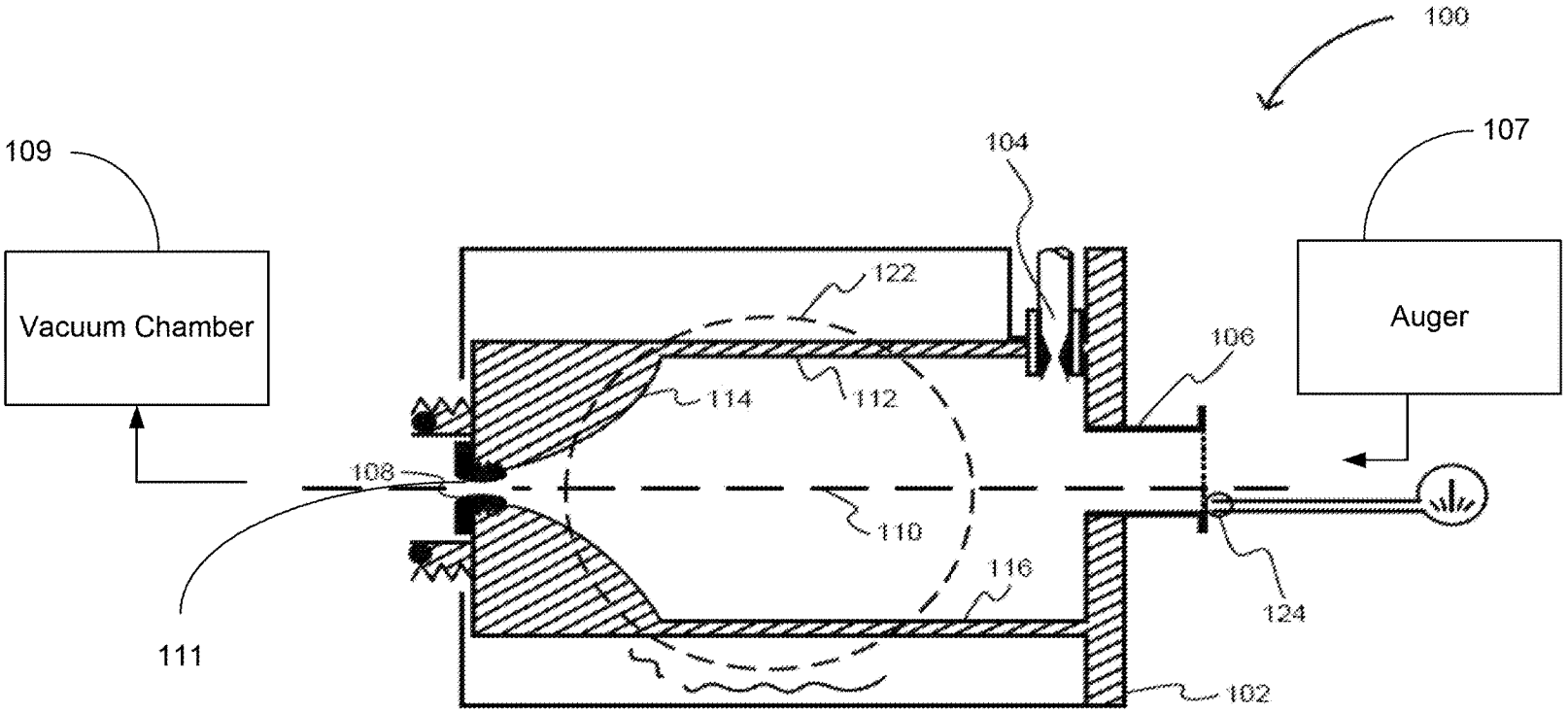
FIG. 1 illustrates a top view of a reactor, in accordance with one or more implementations.
Figure 2:
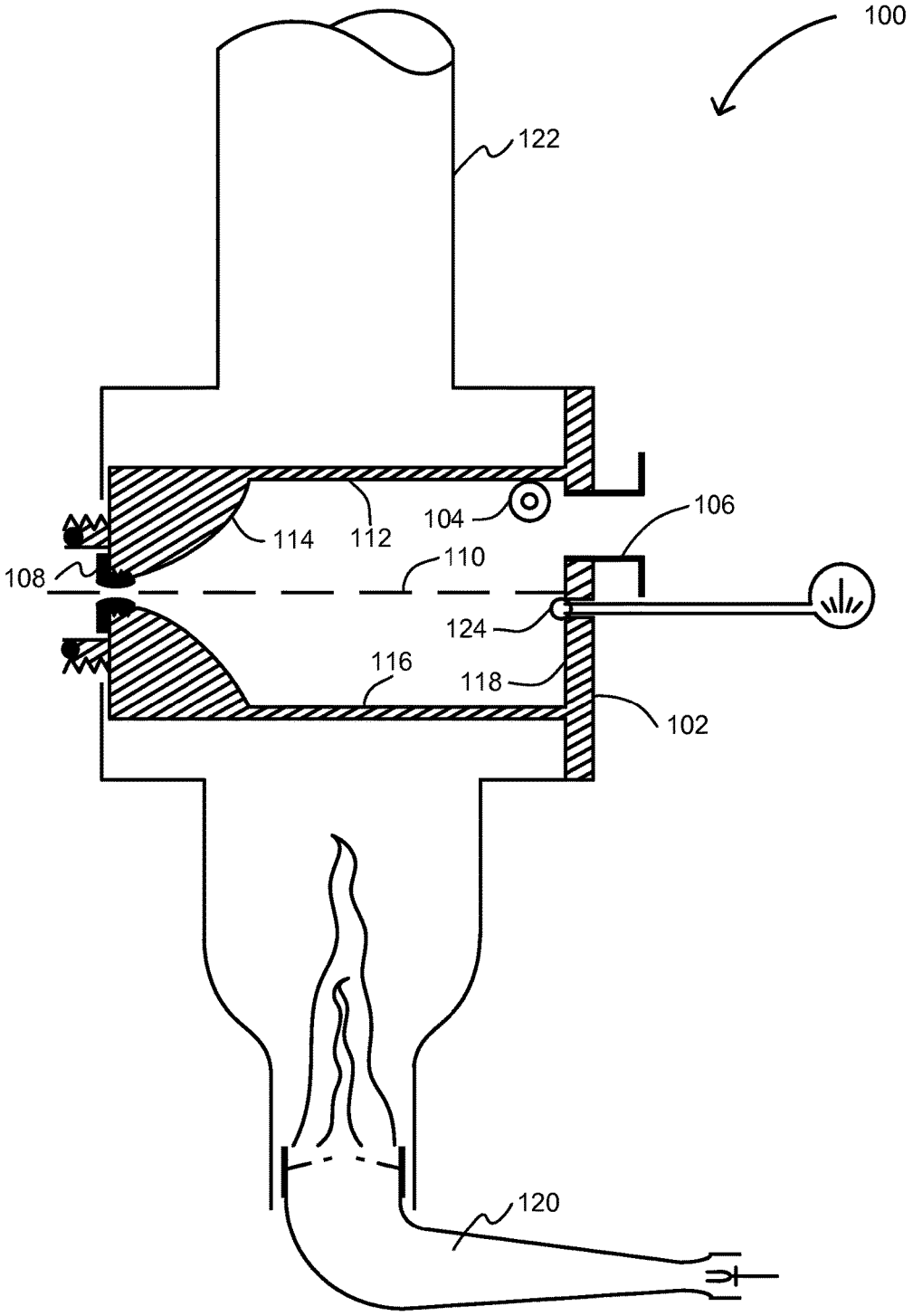
FIG. 2 illustrates a side view of a reactor, in accordance with one or more implementations.
Figure 3:
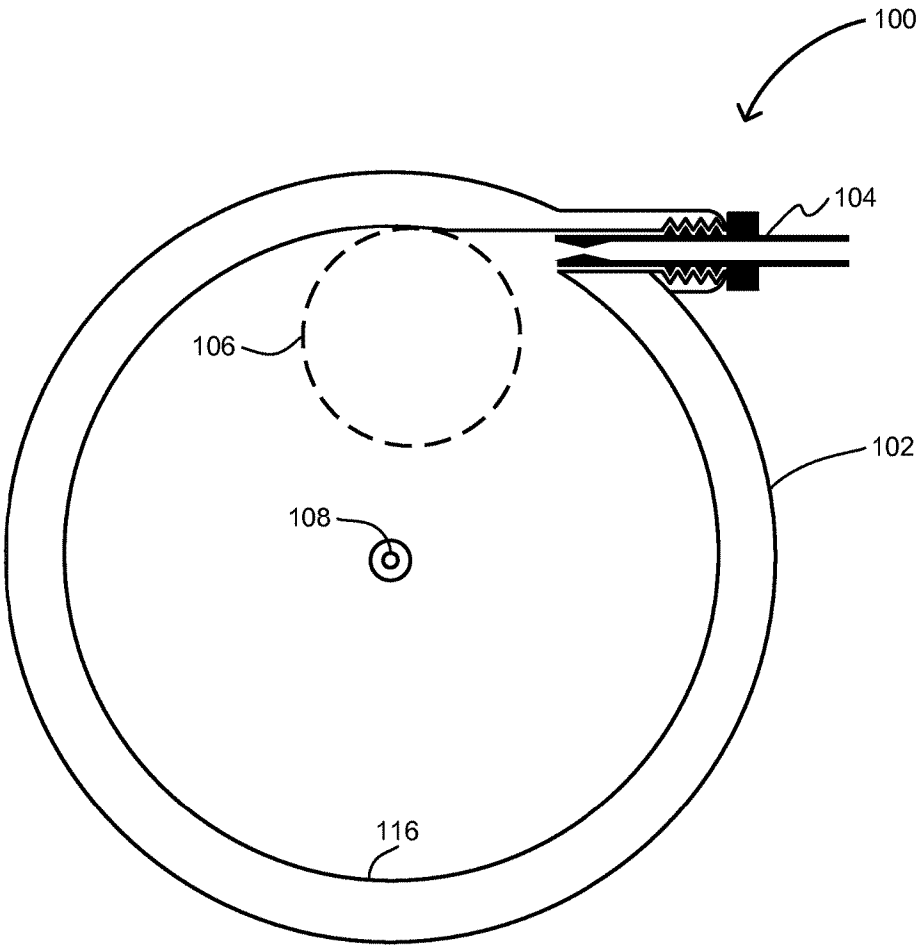
FIG. 3 illustrates a rear view of a reactor, in accordance with one or more implementations.

FIGS. 1, 2, and 3 respectively illustrate a top view, a side view, and a rear view of a reactor 100, in accordance with one or more implementations. The reactor 100 may be configured to facilitate processing including chemical reactions and/or comminution of solid feed materials using shockwaves created in a supersonic gaseous vortex. The reactor 100 may include one or more of a chamber 102, a gas inlet 104, a material inlet 106, an outlet 108, and/or other components.

The chamber 102 may be configured to provide a volume in which material processing occurs. The chamber 102 may have a substantially circular cross-section centered on a longitudinal axis 110 that is normal to the cross-section, or it may have an oval cross-section. The shape of the chamber is not necessarily critical to the embodiments, and only need be of a shape that facilitates a vortex and the creation of shockwaves within chamber 102. In one embodiment, a substantially circular cross-section may facilitate a vortex rotating within chamber 102. A portion 112 of chamber 102 may be shaped as a cylinder. A radius of the substantially circular cross-section of a portion 114 of chamber 102 may continuously decrease at an end of chamber 102 proximal to outlet 108, or the decrease of the radius may be non-continuous and/or non-linear (e.g., decreasing to a greater extent as one moves closer and closer to the outlet 108, or vice versa, thereby producing a cone or hemisphere shape). The decrease of the radius of the substantially circular cross-section of chamber 102 may be configured to cause an acceleration of a rotational speed of the gaseous vortex. The portion 114 of chamber 102 having the decreasing radius of the substantially circular cross-section may be shaped as a cone, a hemisphere, a horn-shape (see, e.g., FIGS. 1 and 2), and/or other shapes.

The chamber 102 may be formed of various materials. The chamber 102 may be formed of a rigid material. The chamber 102 may be formed of a thermally conductive material. The chamber 102 may be formed of an electrically conductive material. According to some implementations, chamber 102 may be formed wholly or partially of steel, iron, iron alloys, silicon carbide, partially stabilized zirconia (PSZ), fused alumina, tungsten carbide, boron nitride, carbides, nitrides, ceramics, silicates, geopolymers, metallic alloys, other alloys, and/or other materials. In some implementations, an internal surface 116 of chamber 102 may be coated with one or more coatings. An exemplary coating may be configured to prevent physical or chemical wear to internal surface 116 of chamber 102. In some implementations, a coating may be configured to promote a chemical reaction within chamber 102. An example of a coating that may promote a chemical reaction, or that may prevent physical or chemical wear, may include one or more of iron; nickel; ruthenium; rhodium; platinum; palladium; cobalt; other transition metals and their alloys, compounds, and/or oxides (e.g., the lanthanide series and their compounds, alloys, and/or oxides), and/or other materials.

The gas inlet 104 may be configured to introduce a high-velocity stream of gas into chamber 102. The gas inlet 104 may be positioned and arranged so as to effectuate a vortex of the stream of gas circulating within chamber 102. The vortex may rotate about longitudinal axis 110 of chamber 102. One embodiment useful to effectuate a vortex is to position the gas inlet so that the stream of gas is directed substantially perpendicular to longitudinal axis 110 of chamber 102. The gas inlet 104 may be disposed so that the stream of gas is directed substantially tangentially to an internal surface of the substantially circular cross-section of the chamber (see, e.g., FIG. 3). The gas inlet 104 may be disposed proximal to material inlet 106.

Other embodiments also may be useful to create a vortex using a high-velocity stream of gas. For example, the nozzle feeding the gas may be configured to accelerate the speed of the gas, or to otherwise create a vortex, as explained in more detail below with reference to FIG. 5. Another embodiment may include a reactor shaped to accelerate the speed of the gas and create a vortex, including an oval shape, a small substantially cylindrical shape, or by the shape of the reactor exit in which the circumference of the reactor decreases. The vortex created in accordance with these embodiments can create shockwaves to facilitate the comminution and reactions within the apparatus.

The gas emitted by gas inlet 104 may include any number of gaseous materials. In some implementations, the gas may include a reduced gas, i.e., a gas with a low oxidation number (or high reduction), which is often hydrogen-rich. The gas may include one or more of steam, methane, ethane, propane, butane, pentane, ammonia, hydrogen, carbon monoxide, carbon dioxide, oxygen, nitrogen, chlorine, fluorine, ethene, hydrogen sulphide, acetylene, and/or other gases. The gas may be a vapor. The gas may be superheated. In some implementations, the gas may be heated beyond a critical point and/or compressed above a critical pressure so that the gas becomes a superheated gas, compressible fluid, and/or a super critical fluid.

Figure 4:
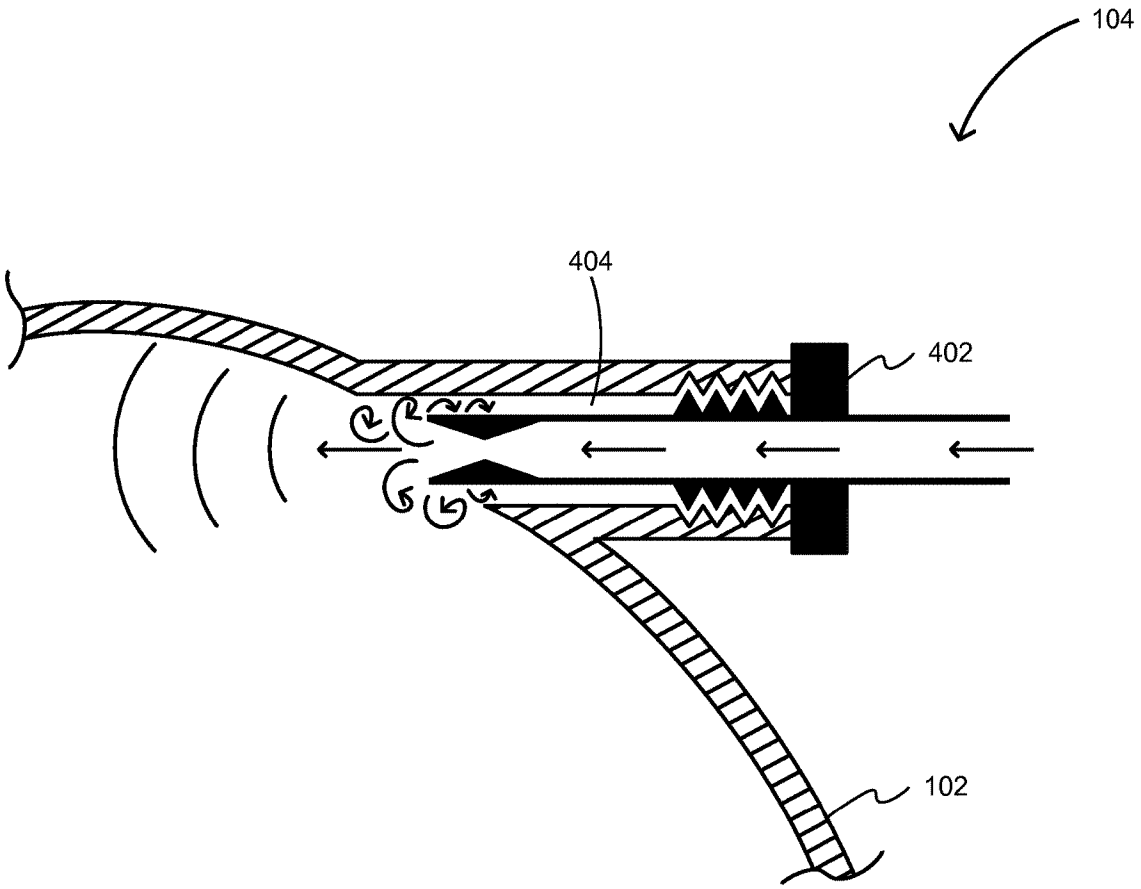
FIG. 4 illustrates a detailed view of a gas inlet of a reactor, in accordance with one or more implementations.

FIG. 4 illustrates a detailed view of a gas inlet 104 of reactor 100, in accordance with one or more implementations. The gas inlet 104 may include an inlet nozzle 402 disposed within gas inlet 104. The inlet nozzle 402 may be configured to be secured in place by screw threads. The inlet nozzle 402 may be configured to accelerate the stream of gas being introduced into chamber 102. In exemplary implementations, inlet nozzle 402 may be configured to emit the stream of gas at a supersonic speed. The inlet nozzle 402 may be configured to emit shock waves in the stream of gas emitted from inlet nozzle 402. The gas inlet 104 may include an annular cavity 404 disposed about inlet nozzle 402. The annular cavity 404 may be configured such that the stream of gas emitted from inlet nozzle 402 resonates within annular cavity 404.

Figure 5:
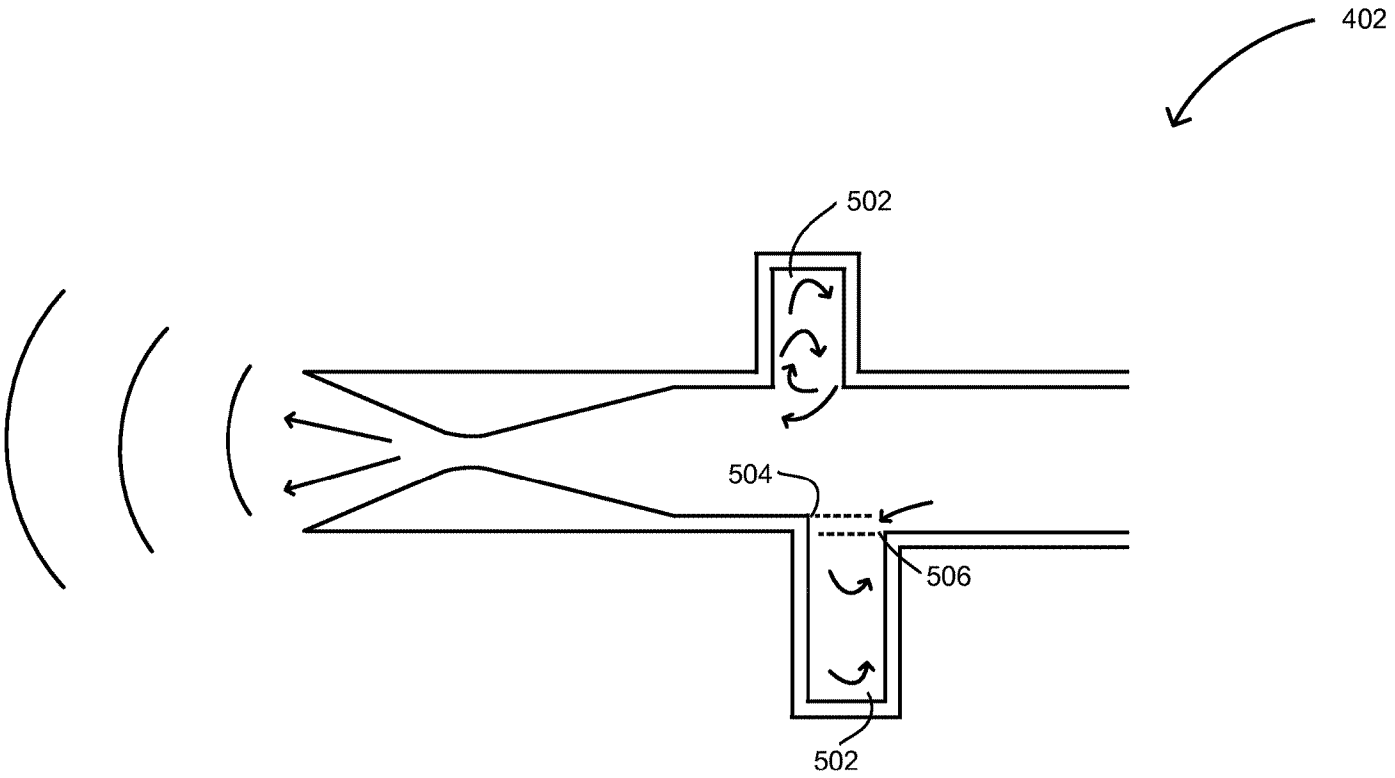
FIG. 5 illustrates a detailed view of an inlet nozzle of a gas inlet, in accordance with one or more implementations.

FIG. 5 illustrates a detailed view of inlet nozzle 402 of gas inlet 104, in accordance with one or more implementations. The inlet nozzle 402 may include one or more resonator cylinders 502. A given resonator cylinder 502 may be disposed within inlet nozzle 402 and may be oriented perpendicular to the main flow of gas through inlet nozzle 402. A given resonator cylinder 502 may be configured such that gas pressure pulses resonate within the given resonator cylinder 502 to induce shock waves within inlet nozzle 402. Shock waves occurring within inlet nozzle 402 may propagate out of inlet nozzle 402 into chamber 102. Different resonator cylinders 502 may have different sizes, shapes or orientations so that corresponding different resonant frequencies result in shock waves occurring at different frequencies. In addition, resonator cylinders 502 may be oriented at an angle other than perpendicularly within inlet nozzle 402, such as at 20, 30, 40, 45, 50, 60, 65, 70, 75, or 80 degrees with respect to the longitudinal axis of inlet nozzle 402. Offset of a lip 504 relative to another lip 506 of a given resonator cylinder 502 may induce pumping in the given resonator cylinder 502.

According to some implementations, inlet nozzle 402 may be configured to introduce shockwaves and/or harmonics in the gas and/or chamber 102. The inlet nozzle 402 may be comprised of, or otherwise configured to include one or more of a Hartmann-Sprenger tube, a Hartmann generator, a Hartmann oscillator, a nozzle utilizing one or more electronically controlled piezoelectric or magnostrictive transducers to control the shockwaves, and/or other types of nozzles. A Hartmann generator may include a device in which shockwaves generated at the edges of a nozzle by a supersonic gas jet resonate with the opening of a small cylindrical pipe, placed opposite the nozzle, to produce powerful ultrasonic sound waves. A Hartmann oscillator may include a gas-jet radiator of sonic and ultrasonic waves. The oscillator may include a nozzle from which gas under a pressure $p>0.2$ meganewtons per square meter (1.93 atmospheres) emerges at supersonic speed. In the process, the gas jet may create compression and rarefaction waves. If a resonator is placed in this flow coaxially with the nozzle at a certain distance, sonic and ultrasonic waves may be radiated. The frequency of the acoustic radiation may be a function of the distance between the nozzle and the resonator, as well as the size of the resonator. Hartmann oscillators may radiate several watts to several kilowatts of acoustic power. In some implementations, reactor 100 may be dimensioned to achieve acoustic power in the megawatt range. If compressed air (from a tank or compressor) is blown through the nozzle, frequencies ranging from 5 or 6 kilohertz up to 120 kilohertz may be obtained. By using hydrogen in place of air, frequencies up to 500 kilohertz may be reached.

Referring again to FIGS. 1, 2, and 3, material inlet 106 may be configured to introduce a material to be processed into chamber 102. The material inlet 106 may be positioned proximal to gas inlet 104. The material inlet 106 may be positioned on a flat surface 118 of chamber 102 that is perpendicular to longitudinal axis 110 of chamber 102. The material inlet 106 may be disposed so that material introduced into chamber 102 is directed parallel to longitudinal axis 110 of chamber 102. The material inlet 106 may be coupled to an auger 107 that advances material through material inlet 106 into chamber 102.

In one embodiment, the material inlet 106 is positioned adjacent gas inlet 104 such that the material is introduced directly into one or more shockwaves created by introduction of the gas stream through gas inlet 104. Such a configuration is illustrated in FIG. 3. In another embodiment, material inlet 106 may be positioned so that the material is introduced directly adjacent to one or more shockwaves. While not intending on being bound by any theory of operation, this configuration is believed to result in superior processing of the material due to the material being introduced directly adjacent or into one or more shockwaves.

Any number of materials may be processed by reactor 100. According to some implementations, the material to be processed may include a solid, a fluid, a liquid, a vapor, a gas, a plasma, a supercritical fluid, a mixture including one or more of the aforementioned materials, and/or other types of materials. By way of non-limiting example, the material to be processed within chamber 102 may include one or more of soil, coal, woodchips, food scraps, ore and/or ore concentrate, mine tailings, tar sands, shale, an organic material, an inorganic material, and/or other materials.

Material processed by reactor 100 may be processed by nonabrasive mechanisms facilitated by shockwaves within chamber 102. For example, the material may be processed by tensile forces caused by shockwaves within chamber. The material may be processed by cavitation in the stream of gas within chamber 102. The processing of the material may be enhanced by positioning the material inlet 106 adjacent to gas inlet 104 such that the material is introduced directly into one or more shockwaves created by introduction of the gas stream through gas inlet 104, as shown in FIG. 3.

The outlet 108 may be configured to emit the gas and processed material from chamber 102. The outlet 108 may be positioned at an opposite end of the chamber as gas inlet 104 and material inlet 106. The outlet may be disposed on longitudinal axis 110 of chamber 102. As the particle size of the processed material is reduced, those particles may migrate toward outlet 108. The outlet 108 may be coupled to a vacuum chamber 109 configured to trap processed material emitted from outlet 108.

In some implementations, outlet 108 may include an outlet nozzle positioned within outlet 108. The outlet nozzle may be configured to pressurize chamber 102. The outlet nozzle may be configured to effectuate a rapid cooling of processed material exiting the chamber. According to some implementations, rapid cooling may reduce or minimize back reactions of metals and/or other chemicals susceptible to back reactions. In some implementations, the outlet nozzle may include a venturi tube 111.

In some implementations, reactor 100 may include a heating component 120 configured to provide heat to chamber 102, as shown in FIG. 2. A heating component 120 may be useful to heat the reactor 100 to create more energy within the chamber 102 to facilitate reactions and comminution of solid materials. The heating component 120 may include one or more of a gas burner, an electrical coil, an induction heater, a dielectric heater, a radiofrequency heater, a microwave heater, a steam jacket, a molten salt bath, and/or other components configured to provide heat.

According to some implementations, reactor 100 may include a ventilation component 122 configured to vent gas from a region surrounding chamber 102. A ventilation component 122 may be useful to vent harmful gases generated in chamber 102, or to reduce the pressure inside chamber 102, if desired. The ventilation component 122 may include one or more of an exhaust fan, a flue or other duct work, a venturi eductor, a turbine to recuperate gas pressure and/or heat, and/or other components configured to vent gas.

The reactor 100 may include one or more sensors 124. A given sensor 124 may provide a signal conveying information related to one or more parameters associated with reactor 100. A given signal may be used to facilitate determination and/or presentation of a corresponding parameter. Exemplary parameters may include one or more of a temperature, a pressure, a velocity (e.g., a velocity of a gaseous vortex within chamber 102), a flow rate of material through material inlet 106 and/or outlet 108, a flow rate of gas through gas inlet 104, a presence of shockwaves and/or cavitations within chamber 102, a voltage, a current, an analysis of gas species exiting the reactor, and/or other parameters associated with reactor 100.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. An apparatus comprising:

a chamber having a longitudinal axis;

a gas inlet configured to introduce a high-velocity stream of gas into the chamber, the gas inlet being disposed and arranged so as to effectuate a vortex of the stream of gas circulating within the chamber, the vortex rotating at a supersonic speed about the longitudinal axis of the chamber;

a material inlet configured to introduce a material to be processed into the chamber, the material inlet being disposed proximal to the gas inlet, the material being processed within the chamber by nonabrasive mechanisms facilitated by shockwaves within the chamber; and an outlet configured to emit the gas and processed material from the chamber, the outlet being disposed at one end of the chamber that is opposite to a second end of the chamber where the gas inlet and the material inlet are disposed.

2. The apparatus of claim 1, wherein a portion of the chamber is shaped as a cylinder having a substantially cylindrical cross section centered on an axis that is normal to the cross-section.

3. The apparatus of claim 1, wherein a radius of a cross-section of a portion the chamber decreases at an end of the chamber proximal to the outlet.

4. The apparatus of claim 3, wherein the decrease of the radius is configured to cause an acceleration of a rotational speed of the gaseous vortex.

5. The apparatus of claim 3, wherein the portion of the chamber having the decreasing radius is shaped as a cone, a hemisphere, or a horn-shape.

6. The apparatus of claim 1, wherein the chamber is formed of a thermally conductive material.

7. The apparatus of claim 1, wherein an internal surface of the chamber is coated with a coating.

8. The apparatus of claim 7, wherein the coating prevents wear to the internal surface of the chamber.

9. The apparatus of claim 7, wherein the coating promotes a chemical reaction within the chamber.

10. The apparatus of claim 1, wherein the gas inlet is disposed so that the stream of gas is directed substantially perpendicular to the longitudinal axis of the chamber.

11. The apparatus of claim 1, wherein the gas inlet is disposed so that the stream of gas is directed substantially tangentially to an internal surface of a cross-section of the chamber.

12. The apparatus of claim 1, wherein the gas is heated beyond a critical point of the gas so that the gas is a super critical fluid.

13. The apparatus of claim 1, wherein the gas inlet includes an inlet nozzle disposed within the gas inlet, the inlet nozzle being configured to emit the stream of gas at a supersonic speed.

14. The apparatus of claim 13, wherein the inlet nozzle is configured to emit shock waves in the stream of gas emitted from the inlet nozzle.

15. The apparatus of claim 13, wherein the inlet nozzle includes one or more of a Hartmann-Sprenger tube, a Hartmann generator, or a Hartmann oscillator.

16. The apparatus of claim 13, wherein the gas inlet includes an annular cavity disposed about the inlet nozzle, the annular cavity being configured to resonate the stream of gas emitted from the inlet nozzle.

17. The apparatus of claim 1, wherein the material inlet is disposed on a flat surface of the chamber that is perpendicular to the longitudinal axis of the chamber.

18. The apparatus of claim 1, wherein the material inlet is disposed so that the material introduced into the chamber is directed parallel to the longitudinal axis of the chamber.

19. The apparatus of claim 1, wherein the material inlet is coupled to an auger that advances material through the material inlet.

20. The apparatus of claim 1, wherein the reactor is configured such that material is processed by tensile forces caused by shockwaves within the chamber.

21. The apparatus of claim 1, wherein the reactor is configured such that the material is processed by cavitation in the stream of gas within the chamber.

22. The apparatus of claim 1, wherein the material to be processed is a solid, a liquid, or a mixture including a solid and a liquid.

23. The apparatus of claim 1, wherein the outlet is disposed on the longitudinal axis of the chamber.

24. The apparatus of claim 1, wherein the outlet is coupled to a vacuum chamber configured to trap processed material emitted from the outlet.

25. The apparatus of claim 1, wherein the outlet includes an outlet nozzle disposed within the outlet, the outlet nozzle being configured to pressurize the chamber.

26. The apparatus of claim 25, wherein the outlet nozzle is configured to effectuate a rapid cooling of processed material exiting the chamber.

27. The apparatus of claim 25, wherein the outlet nozzle includes a venturi tube.

28. The apparatus of claim 1, further comprising:

a heating component configured to provide heat to the chamber; and a ventilation component configured to vent gas from a region surrounding the chamber.

29. An apparatus comprising:

a chamber having a substantially circular or oval cross section, and a longitudinal axis;

a gas inlet disposed so that the stream of gas is directed substantially tangentially to an internal surface of the substantially circular or oval cross-section of the chamber so as to create a vortex of the stream of gas circulating within the chamber, the vortex rotating at a supersonic speed about the longitudinal axis of the chamber to create shockwaves within the chamber;

a material inlet configured to introduce a material to be processed into the chamber, the material inlet being disposed so that the material introduced into the chamber is directed parallel to the longitudinal axis of the chamber and adjacent the gas inlet so that the material is introduced directly into the stream of gas, the material being processed within the chamber by nonabrasive mechanisms facilitated by shockwaves within the chamber; and an outlet configured to emit the gas and processed material from the chamber, the outlet being disposed at one end of the chamber that is opposite to a second end of the chamber where the gas inlet and the material inlet are disposed.

* * * * *